US008703667B2

(12) United States Patent
Morrison et al.

(10) Patent No.: US 8,703,667 B2
(45) **Date of Patent: *Apr. 22, 2014**

(54) AQUEOUS COMPOSITIONS USEFUL IN FILLING AND CONVEYING OF BEVERAGE BOTTLES WHEREIN THE COMPOSITIONS COMPRISE HARDNESS IONS AND HAVE IMPROVED COMPATIBILITY WITH PET

(75) Inventors: Eric D. Morrison, West St. Paul, MN (US); Megan W. Malvey, Roseville, MN (US); Richard D. Johnson, St. Paul, MN (US); Jeffrey S. Hutchison, Minneapolis, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/316,813

(22) Filed: Dec. 12, 2011

(65) Prior Publication Data

US 2012/0190599 A1 Jul. 26, 2012

Related U.S. Application Data

(63) Continuation of application No. 12/778,388, filed on May 12, 2010, now Pat. No. 8,097,568, which is a continuation of application No. 11/426,214, filed on Jun. 23, 2006, now Pat. No. 7,741,255.

(51) Int. Cl.
*C10M 159/20* (2006.01)
*C09K 5/00* (2006.01)
*C10M 173/00* (2006.01)

(52) U.S. Cl.
USPC ..... 508/180; 508/208; 508/545; 508/579; 252/75

(58) Field of Classification Search
USPC ..... 508/180, 208, 579, 545; 252/75
See application file for complete search history.

(56) References Cited

U.S. PATENT DOCUMENTS

| | | | |
|---|---|---|---|
| 3,011,975 | A | 12/1961 | Nitzsche |
| 3,213,024 | A | 10/1965 | Blake |
| 3,514,314 | A | 5/1970 | Nemeth |
| 3,664,956 | A | 5/1972 | Messina |
| 3,853,607 | A | 12/1974 | Iyengar |
| 3,981,812 | A | 9/1976 | Zletz |
| 4,062,785 | A | 12/1977 | Nibert |
| 4,065,590 | A | 12/1977 | Salensky |
| 4,069,933 | A | 1/1978 | Newing |
| 4,083,791 | A | 4/1978 | Elliott |
| 4,105,716 | A | 8/1978 | Sakai |
| 4,132,657 | A | 1/1979 | Verdicchio |
| 4,149,624 | A | 4/1979 | Douty |
| 4,162,347 | A | 7/1979 | Montgomery |
| 4,165,291 | A | 8/1979 | Gragson |
| 4,225,450 | A | 9/1980 | Rosenberger |
| 4,248,724 | A | 2/1981 | MacIntosh |
| 4,252,528 | A | 2/1981 | Decker |
| 4,262,776 | A | 4/1981 | Wilson |
| 4,264,650 | A | 4/1981 | Schulze |
| 4,274,973 | A | 6/1981 | Stanton |
| 4,289,671 | A | 9/1981 | Hernandez |
| 4,324,671 | A | 4/1982 | Christian |
| 4,343,616 | A | 8/1982 | Decker |
| 4,375,444 | A | 3/1983 | Deeken |
| 4,420,578 | A | 12/1983 | Hagens |
| 4,436,200 | A | 3/1984 | Hodlewski |
| 4,478,889 | A | 10/1984 | Maruhashi |
| 4,486,378 | A | 12/1984 | Hirata |
| 4,515,836 | A | 5/1985 | Cobbs, Jr. |
| 4,525,377 | A | 6/1985 | Nickel |
| 4,534,995 | A | 8/1985 | Pocock |
| 4,538,542 | A | 9/1985 | Kennon |
| 4,543,909 | A | 10/1985 | Sharpless |
| 4,555,543 | A | 11/1985 | Effenberger |
| 4,569,869 | A | 2/1986 | Kushida |
| 4,573,429 | A | 3/1986 | Cobbs, Jr. |
| 4,604,220 | A | 8/1986 | Stanton |
| 4,632,053 | A | 12/1986 | Villanueva |
| 4,690,299 | A | 9/1987 | Cannon |
| 4,699,809 | A | 10/1987 | Maruhashi |
| 4,713,266 | A | 12/1987 | Hasegawa |
| 4,714,580 | A | 12/1987 | Maruhashi |
| 4,719,022 | A | 1/1988 | Hyde |
| 4,769,162 | A | 9/1988 | Remus |
| 4,828,727 | A | 5/1989 | McAninch |
| 4,851,287 | A | 7/1989 | Hartsing, Jr. |
| 4,855,162 | A | 8/1989 | Wrasidlo |
| 4,867,890 | A | 9/1989 | Colclough |

(Continued)

FOREIGN PATENT DOCUMENTS

| | | |
|---|---|---|
| CA | 1157456 | 11/1983 |
| EP | 0359330 | 3/1990 |

(Continued)

OTHER PUBLICATIONS

U.S. Appl. No. 60/149,095, filed Aug. 16, 1999, Hei.
U.S. Appl. No. 60/149,048, filed Aug. 16, 1999, Hei.
U.S. Appl. No. 09/619,261, filed Jul. 19, 2000, Corby.
U.S. Appl. No. 60/230,662, filed Sep. 7, 2000, Bennett.
U.S. Appl. No. 11/233,596, filed Sep. 22, 2005, Morrison.
U.S. Appl. No. 11/233,568, filed Sep. 22, 2005, Morrison.
U.S. Appl. No. 11/351,863, filed Feb. 10, 2006, Valencia.
Dupont, "Krytox® Dry Film Lubricants", Nov. 1997, 6 pgs.
Ecolab, "Lube Application to Conveyor Surface/Containers", Jun. 13, 2000, 7 pgs.
Gangal, S., "Polytetrafluoroethylene", Encyclopedia of Chemical Technology, 4th Ed., vol. 11, pp. 621-644, 25 pgs.
Gilbert, Peter, "Conveyor Lubrication in Dairies, Breweries and Beverage Plants", Klensan (Pty) Ltd., S.A. Food Review—Dec. 1981/Jan. 1982, pp. 27-28, 2 pages.

(Continued)

*Primary Examiner* — Ellen M McAvoy
*Assistant Examiner* — Vishal Vasisth
(74) *Attorney, Agent, or Firm* — Merchant & Gould P.C.

(57) ABSTRACT

The passage of a container along a conveyor is facilitated by applying to the container or conveyor aqueous compositions containing hardness ions. The compatibility of the aqueous compositions with PET bottles is improved when the ratio of hardness as $CaCO_3$ to alkalinity as $CaCO_3$ is greater than about 1 to 1.

16 Claims, No Drawings

(56) References Cited

U.S. PATENT DOCUMENTS

| | | | |
|---|---|---|---|
| 4,874,647 | A | 10/1989 | Yatsu |
| 4,919,984 | A | 4/1990 | Maruhashi |
| 4,929,375 | A | 5/1990 | Rossio |
| 4,980,211 | A | 12/1990 | Kushida |
| 4,995,993 | A | 2/1991 | Papke |
| 5,001,935 | A | 3/1991 | Tekkanat |
| 5,009,801 | A | 4/1991 | Wider |
| 5,032,301 | A | 7/1991 | Pawloski |
| 5,073,280 | A | 12/1991 | Rossio |
| 5,104,559 | A | 4/1992 | Pawloski |
| 5,115,047 | A | 5/1992 | Hashimoto |
| 5,145,721 | A | 9/1992 | Kojima |
| 5,160,646 | A | 11/1992 | Scheld |
| 5,174,914 | A | 12/1992 | Gutzmann |
| 5,182,035 | A | 1/1993 | Schmidt |
| 5,202,037 | A | 4/1993 | Lavelle |
| 5,238,718 | A | 8/1993 | Yano |
| 5,244,589 | A | 9/1993 | Liu |
| 5,317,061 | A | 5/1994 | Chu |
| 5,334,322 | A | 8/1994 | Williams, Jr. |
| RE34,742 | E | 9/1994 | Maier |
| 5,352,376 | A | 10/1994 | Gutzmann |
| 5,371,112 | A | 12/1994 | Sayre |
| 5,391,308 | A | 2/1995 | Despo |
| 5,411,672 | A | 5/1995 | Kagaya |
| 5,509,965 | A | 4/1996 | Harry |
| 5,510,045 | A | 4/1996 | Remus |
| 5,559,087 | A | 9/1996 | Halsrud |
| 5,565,127 | A | 10/1996 | Laufenberg |
| 5,573,819 | A | 11/1996 | Nugent, Jr. |
| 5,652,034 | A | 7/1997 | Seiner |
| 5,658,619 | A | 8/1997 | Kirschner |
| 5,663,131 | A | 9/1997 | Winicov |
| 5,670,463 | A | 9/1997 | Maples |
| 5,672,401 | A | 9/1997 | Anglin |
| 5,681,628 | A | 10/1997 | Niederst |
| 5,698,269 | A | 12/1997 | Carlblom |
| 5,721,023 | A | 2/1998 | Ostapchenko |
| 5,723,418 | A | 3/1998 | Person Hei |
| 5,728,770 | A | 3/1998 | Yamamoto |
| 5,747,431 | A | 5/1998 | Taylour |
| 5,783,303 | A | 7/1998 | Tsuei |
| 5,789,459 | A | 8/1998 | Inagaki |
| 5,863,874 | A | 1/1999 | Person Hei |
| 5,871,590 | A | 2/1999 | Hei |
| 5,876,812 | A | 3/1999 | Frisk |
| 5,925,601 | A | 7/1999 | McSherry |
| 5,932,526 | A | 8/1999 | Person Hei |
| 5,935,914 | A | 8/1999 | Theyssen |
| 5,952,601 | A | 9/1999 | Sanford |
| 6,060,444 | A | 5/2000 | Schulz |
| 6,087,308 | A | 7/2000 | Butler |
| 6,096,692 | A | 8/2000 | Hagihara |
| 6,207,622 | B1 | 3/2001 | Li |
| 6,214,777 | B1 | 4/2001 | Li |
| 6,288,012 | B1 | 9/2001 | Li |
| 6,372,698 | B1 | 4/2002 | Strothoff |
| 6,427,826 | B1 | 8/2002 | Li |
| 6,495,494 | B1 | 12/2002 | Li et al. |
| 6,509,302 | B2 | 1/2003 | Li |
| 6,541,430 | B1 | 4/2003 | Beatty |
| 6,569,816 | B2 | 5/2003 | Oohira |
| 6,576,298 | B2 | 6/2003 | Bennett |
| 6,653,263 | B1 | 11/2003 | Küpper |
| 6,673,753 | B2 | 1/2004 | Person Hei |
| 6,677,280 | B2 | 1/2004 | Küpper |
| 6,688,434 | B2 | 2/2004 | Johnson |
| 6,696,394 | B1 | 2/2004 | Ruhr |
| 6,743,758 | B2 | 6/2004 | Li |
| 6,780,823 | B2 | 8/2004 | Li |
| 6,806,240 | B1 | 10/2004 | Hei |
| 6,809,068 | B1 | 10/2004 | Küpper |
| 6,821,568 | B2 | 11/2004 | Bennett |
| 6,855,676 | B2 | 2/2005 | Li et al. |
| 6,967,189 | B2 | 11/2005 | Li |
| 2003/0073589 | A1 | 4/2003 | Li |
| 2004/0029741 | A1 | 2/2004 | Corby |
| 2004/0053793 | A1* | 3/2004 | Li et al. ..... 508/389 |
| 2004/0058829 | A1 | 3/2004 | Hei |
| 2004/0097382 | A1 | 5/2004 | Li |
| 2004/0102337 | A1 | 5/2004 | Li |
| 2004/0167044 | A1* | 8/2004 | Ruhr et al. ..... 508/506 |
| 2004/0235680 | A1 | 11/2004 | Lawrence |
| 2005/0070448 | A1* | 3/2005 | Kupper et al. ..... 508/463 |
| 2005/0288191 | A1 | 12/2005 | Lawrence et al. |
| 2006/0030497 | A1 | 2/2006 | Sperling |
| 2007/0084822 | A1* | 4/2007 | Bohen et al. ..... 215/382 |

FOREIGN PATENT DOCUMENTS

| | | |
|---|---|---|
| EP | 0844299 | 5/1998 |
| GB | 1564128 | 4/1980 |
| WO | WO96/08601 | 3/1996 |
| WO | WO98/51746 | 11/1998 |
| WO | WO01/07544 | 2/2001 |
| WO | WO01/12759 | 2/2002 |
| WO | WO2006/009421 | 1/2006 |
| WO | WO2006/011934 | 2/2006 |
| WO | WO2006/017503 | 2/2006 |

OTHER PUBLICATIONS

Gorton, Hugh J. Ph.D. and Taylour, Jim M. PhD. C Chem, "The Development of New Conveyor Lubricant Technology", MBAA Technical Quarterly, vol. 30, pp. 18-22, 1993, 5 pages.

Henkel Ecolab, "Conveyor Lubrication", 27 Food Ireland, 1 page.

Interflon, "Fin Food Lube Al. High Penetration Teflon® Lubricating Agent Especially Suitable for Automatic Lubrication Systems for the Food Processing Industry", 1998, 20 pgs.

Interflon, "Maintenance Products with Teflon®", http://www.interflon.nl/engels.htm, Jun. 18, 1999, 10 pgs.

Moskala, E., "Environmental Stress Cracking in PET Beverage Containers", BEV-PAK Americas '96, Apr. 15-16, 1996, 14 pgs.

Moskala, E., "Environmental Stress Cracking in PET Carbonated Soft Drink Containers", Bev Tech 98, Mar. 30-Apr. 1, 1998, 22 pgs.

Packaging Hygiene "Maintaining hygiene on filler line conveyor track", 2 pages.

Search Report of EP03076177 dated Jul. 17, 2003, 2 pgs.

Search Report of EP03076178 dated Jun. 12, 2003, 2 pgs.

Synco Chemical Corporation, "Other Super Lube Products . . . What is Super Lube®?" http://www.super-lube.com, May 5, 1999, 5 pgs.

Tekkanat, B. et al., "Environmental Stress Cracking Resistance of Blow Molded Poly(Ethylene Terephthalate) Containers", Polymer Engineering and Science, vol. 32, No. 6, Mar. 1992, pp. 393-397, 5 pgs.

"Vittel Mineralwasser Vitalität und Lebensfreude natürlich erleben" Internet Article, [Online] XP002463555, http://www.vittel.de/de/produkte/vittel_mineralwasser/index.pmode, 1 page.

US 5,863,871, 01/1999, Besse (withdrawn)

* cited by examiner

AQUEOUS COMPOSITIONS USEFUL IN FILLING AND CONVEYING OF BEVERAGE BOTTLES WHEREIN THE COMPOSITIONS COMPRISE HARDNESS IONS AND HAVE IMPROVED COMPATIBILITY WITH PET

CROSS REFERENCE TO RELATED APPLICATIONS

This application is a CON of Ser. No. 12/778,388, filed May 12, 2010 now U.S. Pat. No. 8,097,568 which is a CON of Ser. No. 11/426,214, filed Jun. 23, 2006 now U.S. Pat. No. 7,741,255.

FIELD OF THE INVENTION

This invention relates to aqueous compositions useful in filling and conveying articles. The invention also relates to conveyor systems and containers wholly or partially coated with such aqueous compositions.

BACKGROUND

Carbonated soft drinks are manufactured by combining soft drink concentrate, cold water, and carbon dioxide and then packaging the composition in bottles or cans. The filled container will be transported away from the filler on automated conveyors, may have a label applied, will be inserted into secondary packaging which can be crates, polymer rings, paperboard cartons, or shrink wrapped trays, and finally will be assembled into palletized loads ready for storage and shipping. During handling and transportation from the filler to the final palletized form, containers frequently come into contact with aqueous compositions such as rinse water and water based conveyor lubricants. As used herein, "aqueous composition" refers to compositions that comprise greater than about 90% by weight of water, and includes water, treated water, and water to which one or more functional ingredients have been added. Treated water includes water that has been processed to improve some quality of the water, for example water processed to reduce the concentration of impurities and dissolved materials or to reduce the concentration of viable microorganisms. "Aqueous composition" includes, but is not limited to bottle rinse water, bottle warmer water, case washer water, and lubricant compositions having water as part of the composition. Because containers are filled at high rates up to and exceeding thousands of containers per minute, some spilling of beverage is likely, especially in the case of carbonated beverages which may foam. Containers frequently will be rinsed immediately downstream of the filler to remove spillage. Because containers are filled with ice cold beverage, it is typically required to rinse them with a warm water rinse in order to raise the temperature of their contents to a value above the dew point, thereby minimizing condensation inside secondary packaging such as boxes or shrink wrap enclosures. Therefore, containers will usually be rinsed a second time in a so called bottle warmer or can warmer. To facilitate rapid movement of beverage containers at speeds up to thousands of containers per minute and higher, it is conventionally required to apply lubricant compositions to the bottle or conveyor surfaces.

Preferred containers for carbonated soft drinks are thermoplastic bottles made from polyethylene terephthalate (PET). Polyester resins including PET are hydrolytically susceptible, meaning they can react with water in a process known as hydrolysis. The word hydrolysis comes from the Latin roots "hydro" and "lyso" meaning to break apart with water. In this process, water reacts with PET to create two new chain ends and the PET polymer chain is cut. Polymer under stress is much more reactive with regard to hydrolysis, and amorphous PET like that found in parts of carbonated soft drink bottles is more susceptible to hydrolysis than crystalline or oriented PET. Polymer residing at the bottom of carbonated soft drink bottles near the "gate scar" is under stress from the carbonation and is also amorphous, so it is particularly susceptible to hydrolysis. The gate scar is a round bump in the center of the bottom of every PET beverage bottle which is an artifact of the bottle manufacturing process. In the first step of the bottle manufacturing process, a test tube shaped "preform" that will later be heated and inflated inside of a mold of the final bottle shape is made by injection molding. When PET is forced into the preform injection mold through a gate, a short stem of PET remains attached to the bottom of the test tube, and when this stem is cut, the gate scar is left as a round stub. The gate scar is typically withdrawn slightly from bottom most portion of a PET beverage bottle, and for a bottle standing on a flat table, the gate scar will be about 0.05 to 0.15 inches above the table surface.

Hydrolysis of PET in carbonated soft drink bottles that proceeds to the point of bottle failure is known as "stress cracking." By failure, it is meant that one or more cracks propagate through the wall of the bottle and there is a loss of liquid contents. Bottles which fail by stress cracking and bottles nearby which are wetted with spilled beverage become unsellable, and stress cracking can lead to substantial losses of merchandise and productivity.

The problem of stress cracking in PET bottles filled with carbonated soft drinks has not been well understood. Many investigations have studied stress cracking indirectly. That is, instead of measuring the relative rate of failure, they have measured some property that is believed to correlate with the tendency towards failure such as appearance, time to failure, or rupture stress for samples in contact with chemical compositions. For example, it has been assumed that the appearance of PET beverage bottle bases after exposure to a test composition is an indication of the extent of bottle failure that will occur if bottles contact the test composition in production. However, it can be seen from the Examples below that there is essentially no correlation between the bottle failure rate and that bottle appearance (as quantified by a crazing score) that results from contacting PET bottles with test compositions. Another test used to predict bottle failure rates is the International Society of Beverage Technologists (ISBT) Accelerated Stress Crack Test Method. According to this test, bottles are exposed to sodium hydroxide solution, and the exposure time required to cause the bottle to fail is recorded. In variations of this test, other chemicals have been added to the sodium hydroxide solution. Another indirect test is ISO 6252: 1992(E), "Plastics—Determination of environmental stress cracking (ESC)—Constant-tensile-stress method" available from the International Organization for Standardization (ISO). In the ISO 6252 test, polymer strips are subjected to a constant tensile force corresponding to a stress lower than the yield stress while submerged in a test liquid, and the time or stress at which the strip breaks is recorded. It has often been preferred to use one of these or other indirect test methods to predict failure rates rather than measure failure rates of bottles directly. Indirect test methods are relatively simpler and less expensive to conduct. However, there is growing awareness that indirect tests have overall poor correlation to actual bottle failure rates and that many conclusions about the PET "compatibility" of chemical compositions based on indirect testing are incorrect. Preferably, PET "compatibility" is determined directly by measuring the actual failure rate of bottles in conditions similar to those in bottle filling and storage, for example by using the PET Stress Crack Test described below.

Hydrolysis of ester bonds which form the linkages in PET chains is known to be catalyzed by bases, so it is logical to assume that alkalinity in aqueous compositions that contact PET bottles should be avoided. The conclusion from much testing and experience is that alkalinity in aqueous compositions is indeed a key factor in PET bottle stress cracking. However, a guideline for the permissible levels and types of alkalinity is not generally agreed upon. Three naturally occurring types of alkalinity in water sources are hydroxide alkalinity, carbonate alkalinity, and bicarbonate alkalinity. Generally, bicarbonate alkalinity is the most common type of alkalinity found in water sources, while hydroxide alkalinity is usually absent or present at relatively insignificant levels of less than one percent of the total of hydroxide plus bicarbonate plus carbonate alkalinity. The sum of hydroxide, carbonate, and bicarbonate alkalinity of water which is allowed to contact PET bottles in bottling plants typically ranges between about 10 ppm and 100 ppm, expressed as ppm of $CaCO_3$ (calcium carbonate), with occasional values above 100 ppm. On the other hand, the International Society of Beverage Technologists (ISBT) web site strongly recommends to keep the total alkalinity level (expressed as $CaCO_3$) below 50 mg/L (equivalent to 50 ppm) in all water that could potentially contact the bottle (including, but not limited to: lube makeup water, rinser water, warmer water, case washer, etc) in order to minimize the risk of stress crack failure. When tested using the PET Stress Crack Test in the examples section, water within the ISBT guideline containing 50 ppm or even 25 ppm of bicarbonate alkalinity (expressed as $CaCO_3$) will still give significant amounts of failure, in comparison to deionized or distilled water, which will give no failure.

There have been two main approaches to minimizing the risk of stress cracking due to alkalinity. One approach has been to purify water that comes in contact with PET bottles, and the other has been to use a conveyor lubricant composition that mitigates the effect of water alkalinity.

Purification of water that contacts PET bottles may be done using processes including ion exchange, lime/lime soda softening, split stream softening, and membrane separation processes such as reverse osmosis and nanofiltration. Although the approach of purifying water that contacts PET bottles has proven to be very useful industrially for reduction of stress crack incidents, bottle failure has a strong dependence upon alkalinity even at very low levels and there is uncertainty about what are meaningful specifications for purified water that will provide an acceptable reduction in risk for stress crack failure. Stress cracking has a strong dependence on other environmental variables such as temperature and humidity, and due to the many factors involved in PET stress cracking, it is impossible to determine a single "safe" alkalinity level for aqueous compositions that contact carbonated PET bottles. For example, when PET bottles filled with carbonated liquid are stored under conditions of high temperature and high humidity, bottles that contact water with the ISBT recommended limit of alkalinity at 50 ppm as $CaCO_3$ will exhibit significantly more failure than bottles that have only contacted deionized or distilled water. Alkalinity is not monitored and controlled in all bottling facilities and in case the alkalinity level increases (for example due to equipment failure) it is beneficial to have other means for mitigating the risk of alkaline induced stress cracking.

One way to counteract the effects of alkalinity has been through the use of conveyor lubricant compositions, specifically foaming conveyor lubricants. Conveyor lubricant compositions can be effective to erase the effects of alkalinity in the lubricant composition itself and alkalinity that contacted the bottle in a previous rinse step. For a conveyor lubricant composition that mitigates water alkalinity to be effective at reducing failure due to residual alkalinity from bottle rinsing, it must be applied to bottles downstream of the point of application of the rinse. Effective application of a conveyor lubricant downstream of rinsers and warmers requires the lubricant to contact the susceptible gate scar region. Because this region rides about 0.05 to 0.15 inches above the conveyor surface, in order for the lubricant to make contact, it must be sprayed directly on each bottle or it must be of sufficient depth on the conveyor. In practice, sufficient depth of the lubricant composition on conveyors downstream of rinsers and warmers is provided by foaming the lubricant. In this case, the lubricant must have a tendency to foam. The tendency of a lubricant to foam can be determined using a Foam Profile Test as described below. According to this test, non-foaming lubricants have a foam profile less than about 1.1, moderately foaming lubricants have a foam profile between about 1.1 and 1.4, and foaming lubricants have a foam profile value greater than about 1.4. An example of a foaming conveyor lubricant which works well under conditions of high alkalinity in water sources is LUBODRIVE RX, available from Ecolab, St. Paul, Minn. The foam profile for one part of LUBODRIVE RX diluted with 199 parts of 168 ppm sodium bicarbonate solution is 1.6. Non-foaming lubricants have generally not been used with stress crack susceptible PET packaging in the case that aqueous rinse compositions contain greater than about 50 ppm alkalinity as $CaCO_3$ because of the inability to reach the gate scar region of the bottle.

Newer and particularly preferred conveyor lubricants including silicone emulsion based lubricants are non-foaming. Non-foaming silicone based lubricants will not contact the gate portion of the bottle and some other means is required to lessen the risk of stress cracking resulting from contact of bottles with aqueous rinse compositions that contain alkalinity. Silicone based lubricants are preferred lubricants for PET bottles because they provide improved lubrication properties and significantly increased conveyor efficiency. Silicone containing lubricant compositions are described, for example in U.S. Pat. No. 6,495,494 (Li et al which is incorporated by reference herein in its entirety). Particularly preferred conveyor lubricants are "dry" lubricants as described in U.S. patent application Ser. No. 11/351,863 titled DRY LUBRICANT FOR CONVEYING CONTAINERS, filed on Feb. 10, 2006 which is incorporated by reference herein in its entirety. Dry lubricants include those that are dispensed onto conveyors in a neat undiluted form, those that are applied to the conveyor intermittently, and/or those that leave the conveyor with a dry appearance or are dry to the touch. In the case of dry lubricants, the lubricant will not contact the stress crack susceptible gate portion on the majority of bottles processed.

U.S. patent application Ser. No. 11/233,596 titled SILICONE LUBRICANT WITH GOOD WETTING ON PET SURFACES, filed on Sep. 22, 2005 and U.S. patent application Ser. No. 11/233,568 titled SILICONE CONVEYOR LUBRICANT WITH STOICHIOMETRIC AMOUNT OF AN ORGANIC ACID, filed Sep. 22, 2005 both of which are incorporated by reference herein in their entirety, describe silicone conveyor lubricant compositions that exhibit improved compatibility with PET. While additives described in U.S. patent application Ser. No. 11/233,596 and Ser. No. 11/233,568 represent substantial improvements over prior art compositions, they may impart properties to lubricant compositions that are in some cases undesirable. For example, additives described in U.S. patent application Ser. No.

11/233,596 and Ser. No. 11/233,568 may modify the lubrication properties and may result in a pH for the composition that is low relative to compositions without additives. If added in large amounts, addition of components to improve PET compatibility as described in U.S. patent application Ser. No. 11/233,596 and Ser. No. 11/233,568 may result in reduced stability of the resulting composition in the case that the composition comprises an emulsion. Therefore, there exists an opportunity for improving the combination of PET compatibility and other properties of silicone based conveyor lubricants.

Although much progress has been made in reducing the incidence of stress cracking, every year incidents still occur. While opportunities exist for reducing the risk of stress cracking, there is increasingly a greater need to do so. The beverage industry is characterized by relentless changes including new beverage products, new bottle designs, cost and waste reduction, and faster and more efficient manufacturing processes. It is important that as changes occur, the risk or incidence of stress cracking does not increase.

The rising cost of petrochemicals, including raw materials used to make PET creates an incentive to minimize the amount of PET in every beverage bottle. The practice of minimizing the amount of PET used in a beverage bottle design is called lightweighting. Increased cost of petrochemicals will also provide motivation to use polymers from renewable sources such as agricultural feedstocks. Poly(lactic acid) (PLA) is derived from agricultural sources and like PET, is a polyester that can hydrolyze with water. Improving the compatibility between aqueous compositions used during filling and conveying of bottles and hydrolysis susceptible polymers can facilitate the practice of lightweighting, allow a reduction in the mass of polymer used per bottle, and facilitate the use of new polymers including those derived from renewable sources.

There is also an incentive to use recycled PET as a feedstock for manufacturing of beverage bottles. Unlike many other polymers, the molecular weight of PET can be upgraded during the recycling process, improving the properties of the polymer which may have degraded in previous fabrication and use. However it is well known that processing of PET including injection molding of preforms and blowing preforms to give bottles results in degradation of properties including diminution of molecular weight. Furthermore, post consumer recycled (PCR) PET may include other resins, polyester resins other than PET such as glycol modified PET (also known as PETG or poly ethylene terephthalate glycol copolyester), and impurities such as colorants, catalysts, and remnants of active and passive barrier materials. Increasing the amount of PCR PET in beverage bottles may result in increased risk of bottle failure due to stress cracking. However, a greater PCR polymer content in beverage bottles may be allowable by improving the PET compatibility of aqueous compositions that contact PET bottles during filling and conveying.

For reasons including extending shelf life, allowing smaller package size, improved product quality and allowing lighter bottles, there is motivation to use barrier layers in PET bottles which minimize the egress diffusion of carbon dioxide and ingress diffusion of oxygen. Active barrier materials are those that react with the diffusing species, and passive barriers are those that impede the diffusion of the diffusing species without reaction. While externally applied barrier layers can potentially provide a layer of protection for the underlying PET, use of barrier layers can also increase susceptibility towards stress cracking. For example, barrier layers will generally allow the use of lighter weight bottles. Barrier layers which slow the egress diffusion of carbon dioxide can allow a higher pressure differential to be maintained between the inside and outside of the bottle resulting in greater tensile stress on the bottle wall, and may diminish the concentration of carbon dioxide at the exterior surface of the PET bottle wall, effectively raising the local pH and thereby increasing the rate of hydrolytic degradation of PET Improving the PET compatibility of aqueous compositions which contact bottles may be important to diminish the incidence of stress cracking in PET bottles which comprise a barrier layer.

It is against this background that the present invention has been made.

SUMMARY OF THE INVENTION

Surprisingly, it has been discovered that aqueous compositions have improved compatibility with PET in the case that they contain hardness elements. By hardness elements it is meant metal elements that form metal ions (hardness ions) that go on to form relatively insoluble carbonate compounds, i.e. having solubility products for the carbonate compounds less than about $10^{-4}$ (moles/liter)$^2$. Some non-limiting examples of hardness ions include $Ca^{2+}$, $Mg^{2+}$, $Zn^{2+}$, $Fe^{2+}$, $Mn^{2+}$, and $Cu^{2+}$. Preferably, the concentration of hardness elements is sufficient that there is at least about one ppm of hardness (expressed as $CaCO_3$) in the composition for each ppm of alkalinity (expressed as $CaCO_3$) in the aqueous composition. In some embodiments, the ratio of hardness (expressed as $CaCO_3$) to alkalinity (expressed as $CaCO_3$) is 1 to 1, 1.1 to 1, 1.2 to 1, 1.5 to 1, and 2.0 to 1. In the case that the alkalinity level is 50 ppm as $CaCO_3$, in some embodiments the aqueous compositions will comprise hardness equivalent to 50, 55, 60, 75 or 100 ppm as $CaCO_3$.

Accordingly, the present invention provides, in one aspect, a method for processing and transporting hydrolytically susceptible polymer bottles filled with carbonated beverages along a conveyor wherein the bottle contacts one or more aqueous compositions having greater than about 50 ppm alkalinity as $CaCO_3$, and a ratio of hardness as ppm $CaCO_3$ to alkalinity as ppm $CaCO_3$ equal to at least about 1:1, wherein the passage of bottles is lubricated using a non-foaming conveyor lubricant composition. The present invention provides, in another aspect, method for processing and transporting hydrolytically susceptible polymer bottles filled with carbonated beverages along a conveyor wherein the bottle contacts one or more aqueous compositions having a ratio of hardness as ppm $CaCO_3$ to alkalinity as ppm $CaCO_3$ equal to at least about 1:1, wherein the passage of bottles is lubricated using a dry lubricant composition. The present invention provides, in another aspect, an aqueous lubricant composition comprising a silicone emulsion and greater than about 50 ppm alkalinity as $CaCO_3$ wherein the lubricant composition has a ratio of hardness as ppm $CaCO_3$ to alkalinity as ppm $CaCO_3$ equal to at least about 1:1. The present invention provides, in another aspect, an aqueous lubricant composition comprising between about 0.1 and 1.0 weight percent lubricant concentrate composition and between 99.0 and 99.9 percent dilution water and having greater than about 50 ppm alkalinity as $CaCO_3$, wherein the lubricant composition comprises at least one part hardness as ppm $CaCO_3$ for every part of alkalinity as ppm $CaCO_3$ in the dilution water. The present invention provides, in another aspect an aqueous lubricant composition comprising a silicone emulsion and greater than about 50 ppm hardness as $CaCO_3$. The present invention provides, in another aspect, a lubricant concentrate composition comprising greater than about 10,000 ppm hardness as $CaCO_3$. The present invention provides, in another aspect, a rinse composition concentrate comprising greater than 10,000 ppm hardness as $CaCO_3$. As used herein, an aqueous rinse composition includes any aqueous composition comprising greater than about 90 percent by weight of water which is applied to bottles in such a way as to essentially wet the majority of the bottle surface. Aqueous rinse compositions may be used for reasons including to remove spilled beverage, to prevent scuffing, to facilitate movement of the bottles along the conveyor system, or to raise or lower the temperature of bottle contents. The present invention provides, in another aspect, a method for processing and transporting hydrolytically susceptible polymer bottles filled with carbonated beverages along a conveyor wherein the bottle contacts one or more aqueous compositions having a ratio of hardness as ppm $CaCO_3$ to alkalinity as ppm $CaCO_3$ equal to at least about 1:1, wherein the bottles are capable to contain at least 20 ounces of beverage and the empty bottles weigh less than about 24 grams per bottle. The present invention provides, in another aspect, a method for processing and transporting hydrolytically susceptible polymer bottles filled with carbonated beverages along a conveyor wherein the bottle contacts one or more aqueous compositions having a ratio of hardness as ppm $CaCO_3$ to alkalinity as ppm $CaCO_3$ equal to at least about 1:1, wherein the bottles comprise greater than about 10% by weight of a polymer other than PET. The present invention provides, in another aspect, a method for processing and transporting hydrolytically susceptible polymer bottles filled with carbonated beverages along a conveyor wherein the bottle contacts one or more aqueous compositions having a ratio of hardness as ppm $CaCO_3$ to alkalinity as ppm $CaCO_3$ equal to at least about 1:1, wherein the bottles comprise greater than about 12% by weight of PCR polymer content. The present invention provides, in another aspect, a method for processing and transporting hydrolytically susceptible polymer bottles filled with carbonated beverages along a conveyor wherein the bottle contacts one or more aqueous compositions having a ratio of hardness as ppm $CaCO_3$ to alkalinity as ppm $CaCO_3$ equal to at least about 1:1, wherein the bottles comprise an active or a passive barrier material. The present invention provides, in another aspect, a method for processing and transporting hydrolytically susceptible polymer bottles filled with carbonated beverages along a conveyor wherein the bottle contacts one or more aqueous compositions in which the ratio of hardness as ppm $CaCO_3$ to bicarbonate alkalinity as ppm $CaCO_3$ is at least about 1.5:1. These and other aspects of this invention will be evident upon reference to the following detailed description of the invention.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

The invention provides aqueous compositions useful in the filling and conveying of containers wherein the aqueous composition includes hardness elements. Aqueous compositions according to the present invention may be useful to rinse containers thereby removing spilled beverages or effecting an increase in the temperature of the container contents. Also, aqueous compositions according to this invention may be useful to reduce the coefficient of friction between conveyor parts and containers and thereby facilitate movement of containers along a conveyor line. Finally, aqueous compositions of this invention may in some other way improve the efficiency of package processing or a property of the filled package.

According to the present invention, the source of hardness elements in aqueous compositions may be impurities in the water itself or water used to prepare the aqueous composition, or the source of hardness elements may be intentionally added salts of hardness elements, or the source of hardness elements may be a combination of intentionally added hardness element salts and impurities in the water or water used to prepare aqueous compositions and lubricant compositions. In the final aqueous composition, a majority of the hardness element concentration may be intentionally added, for example as a constituent of a rinse concentrate or a lubricant concentrate and a minority may be provided by the water used to prepare the aqueous composition. For example, greater than about 90 percent of the hardness in the final composition or greater than about 70 percent of the hardness in the final composition may be provided by a concentrate composition and less than about 10 percent of the hardness or less than 30 percent of the hardness may be provided by water used to dilute the concentrate. Alternatively, greater than about 10 percent of the hardness element concentration or greater than 30 percent of the hardness element concentration in the final aqueous composition may be provided by the water used to prepare the aqueous composition and less than about 90 percent of the hardness element concentration or less than about 70 percent of the hardness element concentration may be intentionally added. Total hardness provided in the water used to prepare the aqueous composition may include "carbonate hardness" and "noncarbonate hardness." When hardness is numerically greater than the sum of carbonate and bicarbonate alkalinity, that amount of hardness equivalent to the total alkalinity is called "carbonate hardness" while the amount of hardness in excess of this is called "noncarbonate hardness." Carbonate hardness is attributable to dissolved metal carbonate and bicarbonate salts while noncarbonate hardness is usually attributable to dissolved metal sulfates and chlorides. Moderate to high hardness water (50 ppm to 300 ppm) is typically associated with soils formed in limestone ($CaCO_3$) deposited watersheds. In this case the hardness is primarily due to dissolved bicarbonate salts, i.e. the hardness is primarily "carbonate hardness" and the ratio of hardness (as $CaCO_3$) to alkalinity (as $CaCO_3$) is close to 1.

Hardness of aqueous compositions can be determined by calculation according to the methods on page 2-36 of Standard Methods for the Examination of Water and Wastewater, $18^{th}$ Edition 1992 (Eds. Greenberg, A. E., Clesceri, L. S., and Eaton, A. D.). According to this method, hardness is computed from separate determinations of hardness elements. The concentration of hardness elements may be determined by an analytical method such as atomic absorption (AA) or inductively coupled plasma (ICP) spectroscopy, or it may be known from formulation data. Hardness due to calcium and magnesium can be calculated by the following equation: hardness (in terms of ppm $CaCO_3$)=2.497*(ppm Ca)+4.118*(ppm Mg). This method can be extended to include other hardness elements, where the contribution of other hardness elements expressed in terms of ppm $CaCO_3$ is equal to (100.1*ppm of hardness element)/(atomic weight of hardness element). For example, in Example 1 the ppm hardness as $CaCO_3$ of water containing 220 ppm $CaCl_2$ (equivalent to 79.4 ppm Ca) can be calculated according to:

$$\text{ppm as } CaCO_3 = 2.497 * 79.4 = 198 \text{ ppm hardness as } CaCO_3$$

In Example 5, the ppm hardness as $CaCO_3$ of a solution containing 136 ppm zinc chloride (equivalent to 65.4 ppm Zn) can be calculated:

$$\text{ppm as } CaCO_3 = (100.1 * 65.2)/65.4 = 100 \text{ ppm hardness as } CaCO_3$$

Concentration of hardness elements present in aqueous compositions can also be determined for example by analytical methods including titration with a complexing agent as described on page 2-36 Standard Methods for the Examination of Water and Wastewater, $18^{th}$ Edition. The titration for hardness in aqueous compositions can be done using ethylene diamine tetraacetic acid (EDTA) as a complexing agent and either Eriochrome Black T or 3-hydroxy-4-(6-hydroxy-m-tolylazo) naphthalene-1-sulfonic acid (Calmagite) as a visible indicator. It is not desirable to use an inhibitor for the titration so that hardness elements such as zinc will titrate as hardness. For example, 1000 g of aqueous compositions can be titrated from the wine-red to blue color change of Calmagite using a 0.13 molar solution of disodium EDTA. In this case, the hardness as ppm $CaCO_3$ per mL of titrant can be calculated according to:

$$\text{ppm hardness as } CaCO_3 \text{ per 1.0 mL of titrant} = \frac{(1.0 \text{ mL}) \times (0.13 \text{ moles } EDTA/1000 \text{ mL}) \times (1 \text{ mole } CaCO_3/\text{mole } EDTA) \times 100 \text{ g } CaCO_3/\text{mole}}{1000 \text{ g}} = 0.013 \text{ g } CaCO_3/1000 \text{ g} = 13 \text{ ppm as } CaCO_3 \text{ per mL of titrant}$$

The total alkalinity of aqueous compositions can be determined by an acid base titration. For example, 1000 g of aqueous composition can be titrated to approximately pH 4.0 using 0.1 normal (0.1 N) HCl solution. In this case, the ppm total alkalinity as $CaCO_3$ per mL of titrant can be calculated according to:

$$\text{total alkalinity as } CaCO_3 \text{ per 1.0 mL of titrant} = \frac{(1.0 \text{ mL}) \times (0.1 \text{ equivalent}/1000 \text{ mL}) \times (50 \text{ g } CaCO_3/\text{equivalent})}{1000 \text{ g}} = 0.005 \text{ g } CaCO_3/1000 \text{ g} = 5 \text{ ppm as } CaCO_3 \text{ per mL of titrant}$$

The total alkalinity in aqueous compositions can be classified as bicarbonate, carbonate, and hydroxide alkalinity based on results of titration to pH 8.3 (phenolphthalein endpoint) and pH 4.0 (total alkalinity endpoint) as described on pages 2-27 and 2-28 of Standard Methods for the Examination of Water and Wastewater, $18^{th}$ Edition.

The total alkalinity of the compositions in the Examples herein can be calculated by formulation. For example, in Example 1 the ppm alkalinity as $CaCO_3$ of water containing 168 ppm $NaHCO_3$ can be calculated according to:

$$\text{alkalinity as } CaCO_3 = \frac{(0.168 \text{ g } NaHCO_3/1000 \text{ g})}{84 \text{ g } NaHCO_3/\text{equivalent}} \times (50 \text{ g } CaCO_3/\text{equivalent}) = 0.100 \text{ g } CaCO_3/1000 \text{ g} = 100 \text{ ppm alkalinity as } CaCO_3$$

The mechanism whereby the presence of hardness elements improves the PET compatibility of aqueous compositions is not known. It is believed that the presence of hardness elements interferes with the ester hydrolysis reaction which is known to be catalyzed by acids and bases. While not wishing to be bound by theory, one possible mechanism for the improvement of PET compatibility of aqueous compositions is that hardness ions may be limiting the amount of $CO_2$ loss from bicarbonate ion, slowing or preventing the formation of more basic and more destructive carbonate ($CO_3^{2-}$) and hydroxide ($OH^-$) anions. Water sources typically contain alkalinity in the form of bicarbonate ion, which can become carbonate and hydroxide ions when $CO_2$ evaporates during partial or complete evaporation of aqueous compositions according to equations (1) and (2).

$$2HCO_3^- \rightarrow CO_3^{2-} + CO_2 + H_2O \quad (1)$$

$$H_2O + CO_3^{2-} \rightarrow 2OH^- + CO_2 \quad (2)$$

Slowing the loss of $CO_2$ by evaporation may result from precipitating carbonate ion as an insoluble metal carbonate salt. For example, calcium chloride (a hardness salt) may react with sodium bicarbonate according to equation (3):

$$CaCl_2 + 2NaHCO_3 \rightarrow CaCO_3 + 2NaCl + CO_2 + H_2O \quad (3)$$

In this case, because of the precipitation of carbonate ion as relatively insoluble calcium carbonate, further loss of carbon dioxide to form hydroxide ion according to equation (2) may be prevented.

Because a product of the reaction of hardness ion with bicarbonate ion is a metathesis product salt of the original hardness salt (for example the metathesis product salt in equation (3) above is NaCl), it is believed to be preferable that the hardness ion salt be selected from the group of hardness ion salts of strong acids with pKa values less than about 3. Hardness ion salts of weaker acids with pKa values greater than about 3 are believed to be less preferred because the precipitation reaction may yield more basic and possibly less compatible salt products. Preferred hardness salts include halides, nitrates, alkyl and aryl sulfonates such as methane sulfonate and para toluene sulfonate, and sulfates. Hardness ions present in aqueous compositions may also be in the form of bicarbonate salts, especially in the case that the source of hardness ions are impurities in the source water.

While precipitation of carbonate salts of hardness ions may be important in the mechanism whereby the PET compatibility of aqueous compositions is improved, it is not required and in fact it is not preferred for precipitation of carbonate salts to occur in use compositions as distributed or dispensed. As used herein, "use composition" means a composition as it is applied to the bottle or conveyor system. Precipitation of carbonate salts in use compositions may cause problems in distribution or dispensing, for example clogging of filters or spray nozzles. On the other hand, compatibilization of relatively dilute solutions of bicarbonate alkalinity is not required, as concentrations of sodium bicarbonate at concentrations up to and exceeding 525 ppm (313 ppm alkalinity as $CaCO_3$) do not cause failure of PET bottles unless evaporation is allowed to occur. If the PET compatibility test described in the Examples is conducted using 525 ppm sodium bicarbonate under conditions where solution evaporation is prevented, for example in the case that bottles and test solution are sealed in a resealable zipper type plastic bag, the failure rate is zero percent.

Precipitation of carbonate salts from aqueous compositions will not occur as long as concentrations of the hardness ions and carbonate ion remain below the solubility limit. For example, according to the $57^{th}$ Edition of the Handbook of Chemistry and Physics, the solubility product for magnesium carbonate at 12° C. is $2.6\times10^{-5}$ (moles/liter)$^2$. This means that so long as the product of the concentration of magnesium ion (in moles/liter) times the concentration of carbonate ion (in moles/liter) remains below $2.6\times10^{-5}$ (moles/liter)$^2$, the carbonate salt will not precipitate. In Example 11, the concentration of magnesium ions is $2\times10^{-3}$ moles/liter and the concentration of bicarbonate ion is also $2\times10^{-3}$ moles/liter. In this case, if all of the bicarbonate ion were converted to carbonate ion by loss of $CO_2$ according to equation (1), the resulting carbonate ion concentration would be $1\times10^{-3}$ moles/liter and the product of magnesium ion concentration and carbonate ion concentration would be $2\times10^{-6}$ (moles/liter)$^2$, substantially below the precipitation limit. In Example 6, the concentration of calcium ions is $1.6\times10^{-3}$ moles/liter and the concentration of bicarbonate ion is $5.2\times10^{-3}$ moles/liter. In this case, if all of the bicarbonate ion were converted to carbonate ion by loss of $CO_2$, the resulting carbonate ion concentration would be $2.6\times10^{-3}$ moles/liter and the product of calcium ion concentration and carbonate ion concentration would be $4.2\times10^{-6}$ (moles/liter)$^2$, which is greater than the solubility product for calcium carbonate (calcite) which is $1\times10^{-8}$ (moles/liter)$^2$ at 15° C. However, calcium carbonate does not precipitate from the hard alkaline municipal water because the alkalinity remains predominantly in the form of bicarbonate, not carbonate unless substantial loss of $CO_2$ occurs.

Another potential mechanism of improved compatibility in the presence of hardness elements may be interaction of hardness metal ions with carboxylate end groups on the polymer. It is believed that PET polymer chains with carboxylate chain ends may cause autocatalytic hydrolysis of the PET polymer chain. For example a deprotonated carboxylic acid chain end may promote hydrolysis of other ester linkages within the same or adjacent PET polymer chains. Hardness ions that form relatively less soluble carbonates also form relatively less soluble salts with long chain carboxylic acid compounds. The relatively lower solubility of hardness ion salts of PET carboxylate polymer chain ends relative to other cations such as monovalent cations may slow the rate of hydrolytic polymer autocatalysis.

Regardless of the mechanism, the presence of hardness ions according to the present invention has been observed to reduce stress cracking in PET bottles when compared to prior art and comparison compositions. Accordingly, compositions of the present invention comprise a sufficient concentration of one or more hardness ions to improve the compatibility of the composition with PET. Preferably, there is at least about one ppm of hardness (expressed as $CaCO_3$) in the composition for each ppm of alkalinity (expressed as $CaCO_3$) in the aqueous composition.

Typically, it has been suggested to avoid hardness ions or to use sequestering agents and chelating agents to improve the hardness tolerance of aqueous compositions useful in the filling and conveying of PET bottles, even in the case that other formulation components are compatible with hardness ions. For example, sequestrants and chelating agents are frequently listed as formulation components for conveyor lubricant compositions. Although sequestrants and chelating agents are very important additions to compositions containing hardness intolerant anionic surfactants such as fatty acids salts and phosphate ester salts, they are frequently claimed as additives to other lubricant compositions as well. See U.S. Pat. Nos. 5,352,376, 5,559,087, 5,935,914, US Patent Publication No. 2004/0235680, US Patent Publication No. 2004/0029741, US Patent Publication No. 2006/0030497, and U.S. patent applications Ser. No. 11/233,596 and Ser. No. 11/233,568. Because the present invention is directed to including hardness elements in the compositions, rather than sequestering them out, the present invention can be, in some embodiments, substantially free of sequestering agents and chelating agents.

Although the concept of adding hardness is contrary to conventional practices which are to avoid or sequester hardness elements, the use of hardness to improve PET compatibility of aqueous compositions has proven to be very effective. It is believed that the concept, methods, and compositional features of the present invention extend also to improving compatibility of aqueous compositions with other polymers that are susceptible to hydrolysis. For example, polycarbonate materials including bisphenol-A polycarbonate are increasingly susceptible to hydrolysis under alkaline conditions. Poly(lactic acid) (PLA) is considered a "sustainable" alternative to petroleum based products including PET, since it is derived from the fermentation of agricultural products such as corn or other sugar or starch rich crops such as sugar beets or wheat. Like PET, PLA is a polyester and contains ester linkages which are subject to cleavage by hydrolysis. Although PLA is currently more expensive than many petroleum derived polymers, its price has been falling as more production comes online, while the cost of petroleum and petroleum based products continues to increase. Compositions of the present invention may advantageously be used with containers made of polymeric materials that hydrolyze under alkaline conditions including PET and PLA in the form of both non-refillable (e.g. so called "one-way" bottles) as well as refillable (e.g. so called "Ref-PET") containers.

The present invention provides, in one aspect, a method for rinsing containers comprising applying an aqueous composition to the container wherein the aqueous composition comprises hardness ions in an amount sufficient to provide a value of hardness as ppm $CaCO_3$ that is equal to at least about the value of alkalinity as ppm $CaCO_3$. In the case that bottle rinsing is done for purposes of raising the temperature of the contents, as in the so called bottle warmer, it is particularly preferred to recirculate the aqueous rinse composition. By recirculating the aqueous rinse composition within a bottle warmer, not only is water recycled and conserved but heat is recycled and conserved as well. However, maintaining and recirculating a pool of warm aqueous composition may allow growth of microorganisms which can cause odor, unsightly appearance, interfere with application of the aqueous composition to bottles, and reduce effectiveness of heat transfer. For this reason, aqueous compositions useful for rinsing bottles advantageously include sanitizing agents. Useful sanitizing agents include quaternary ammonium compounds or peracetic acid and include commercial products such as STER-BAC, Cooling Care 2065, SURPASS 100, and SURPASS 200 available from Ecolab, St. Paul, Minn. Aqueous rinse compositions comprising a sanitizer according to the present invention may be prepared by diluting a sanitizing concentrate such as STER-BAC, Cooling Care 2065, SURPASS 100, and SURPASS 200 with hard water, or may be prepared by adding to water both a sanitizing concentrate plus a compatibility improving concentrate, wherein the compatibility improving concentrate comprises one or more salts of hardness ions.

Aqueous compositions of the present invention that are used for rinsing can be applied undiluted or may be diluted before use. It may be desirable to provide compositions of the present invention in the form of concentrates that can be diluted with water at the point of use to give aqueous use compositions. As used herein, "use composition" means a composition as it is applied to the bottle or conveyor system and "concentrate" means a composition that is diluted with water and/or a hydrophilic diluent to give a use composition. Inventive rinse concentrate compositions therefore comprise sufficient concentrations of hardness ions such that when one part of the concentrate composition is diluted with between 200 and 10,000 parts of water and/or a hydrophilic diluent to give a use composition, the ratio of the total hardness of the composition (expressed as ppm $CaCO_3$) to the total alkalinity of the composition (expressed as ppm $CaCO_3$) is greater than about 1 to 1 while the total alkalinity of the composition is greater than about 50 ppm as $CaCO_3$. Accordingly, inventive rinse concentrate compositions comprise hardness of at least about 10,000 ppm as $CaCO_3$, at least about 15,000 ppm as $CaCO_3$, or at least about 20,000 ppm as $CaCO_3$. Rinse concentrates according to the present invention may be liquid, semi-solid, or solid.

The present invention provides, in another aspect, a method for lubricating the passage of a container along a conveyor comprising applying a composition of an aqueous lubricant composition to at least a portion of the container contacting surface of the conveyor or to at least a portion of the conveyor-contacting surface of the container wherein the lubricant composition comprises greater than about one part hardness as ppm $CaCO_3$ for every part alkalinity as ppm $CaCO_3$. Preferred conveyor lubricant compositions include compositions based on silicone materials, fatty amines, nonionic surfactants, and other materials that may be formulated to contain hardness ions. Lubricant materials that are not useful in the compositions of the present invention include those that are "incompatible" with hardness ions or form precipitates in the presence of hardness ions such as fatty acid lubricants and phosphate ester lubricants.

Lubricant compositions of the present invention can be applied as is or may be diluted before use. It may be desirable to provide compositions of the present invention in the form of concentrates that can be diluted at the point of use to give use compositions. If diluted, preferred ratios for dilution at the point of use range from about 1:200 to 1:1000 (parts of concentrate:parts of diluent). Inventive lubricant concentrate compositions therefore comprise sufficient concentrations of hardness ions such that when one part of the concentrated aqueous concentration is diluted with between 200 and 10,000 parts of water and/or hydrophilic diluent to give a use composition, the ratio of the total hardness of the composition (expressed as ppm $CaCO_3$) to the total alkalinity of the composition (expressed as ppm $CaCO_3$) is greater than about 1 to 1 while the total alkalinity of the composition is greater than about 50 ppm as $CaCO_3$. Accordingly, concentrate compositions comprise hardness of at least about 10,000 ppm as $CaCO_3$, at least about 15,000 ppm as $CaCO_3$, or at least about 20,000 ppm as $CaCO_3$. Lubricant concentrates according to the present invention may be liquid, semi-solid, or solid.

Preferred silicone lubricant compositions comprise one or more water miscible silicone materials, that is, silicone materials that are sufficiently water-soluble or water-dispersible so that when added to water at the desired use level they form a stable solution, emulsion, or suspension. A variety of water-miscible silicone materials can be employed in the lubricant compositions, including silicone emulsions (such as emulsions formed from methyl(dimethyl), higher alkyl and aryl silicones; and functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E2140 polydimethylsiloxane (a 35% siloxane emulsion commercially available from Lambent Technologies, Inc.), E2140 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones). Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.). Suitable silicone emulsions and other water-miscible silicone materials are listed in aforementioned U.S. patent application Ser. No. 11/233,596 and Ser. No. 11/233,568 which are incorporated herein by reference in their entirety.

Polydimethylsiloxane emulsions are preferred silicone materials. Generally the concentration of the active silicone material useful in the present invention exclusive of any dispersing agents, water, diluents, or other ingredients used to emulsify the silicone material or otherwise make it miscible with water falls in the range of about 0.0005 wt. to about 10 wt. %, preferably 0.001 wt. % to about 8 wt. %, and more preferably 0.002 wt. % to about 5 wt. %. In the case that the lubricant composition is provided in the form of a concentrate, the concentration of active silicone material useful in the present invention exclusive of any dispersing agents, water, diluents, or other ingredients used to emulsify the silicone material or otherwise make it miscible with water falls in the range of about 0.05 wt. % to about 20 wt. %, preferably 0.10 wt. % to about 5 wt. %, and more preferably 0.2 wt. % to about 1.0 wt. %. Preferred lubricant compositions are substantially aqueous that is, they comprise greater than about 90% of water.

In the case that lubricant compositions are provided in the form of concentrates, it is particularly preferred to select silicone materials and other formulation constituents that form stable compositions at 100 to 1000 times the concentration of the use composition.

Lubricant compositions of the present invention may be "dry" lubricants as described in aforementioned U.S. patent application Ser. No. 11/351,863 which is incorporated by reference herein in its entirety. Dry lubricants include those that are dispensed onto conveyors in a neat undiluted form, those that are applied to the conveyor intermittently, and/or those that leave the conveyor with a dry appearance or are dry to the touch. Preferred "dry" lubricants comprise a silicone material, water or a combination of water plus hydrophilic diluent, and optionally a water miscible lubricant as described in U.S. patent application Ser. No. 11/351,863. Preferred amounts for the silicone material, water miscible lubricant and water or hydrophilic diluent are about 0.1 to about 10 wt. % of the silicone material (exclusive of any water or other hydrophilic diluent that may be present if the silicone material is, for example, a silicone emulsion), about 0 to about 20 wt. % of the water miscible lubricant, and about 70 to about 99.9 wt. % of water or hydrophilic diluent. More preferably, the lubricant composition contains about 0.2 to about 8 wt. % of the silicone material, about 0.05 to about 15 wt. % of the water miscible lubricant, and about 75 to about 99.5 wt. % of water or hydrophilic diluent. Most preferably, the lubricant composition contains about 0.5 to about 5 wt. % of the silicone material, about 0.1 to about 10 wt. % of the hydrophilic lubricant, and about 85 to about 99 wt. % of water or hydrophilic diluent.

In some embodiments, the lubricant compositions may also contain a wetting agent. Silicone lubricant compositions that comprise a wetting agent and have improved compatibility with PET are disclosed in aforementioned U.S. patent application Ser. No. 11/233,596 titled SILICONE LUBRICANT WITH GOOD WETTING ON PET SURFACES. In some embodiments, the lubricant compositions may also contain a stoichiometric amount of an organic acid. Lubricant compositions that comprise a stoichiometric amount of an organic acid and have improved compatibility with PET are disclosed in aforementioned U.S. patent application Ser. No. 11/233,568 titled SILICONE CONVEYOR LUBRICANT WITH STOICHIOMETRIC AMOUNT OF AN ORGANIC ACID.

Fatty amine conveyor lubricant compositions useful in the present invention include compositions based on fatty diamine compounds as disclosed in U.S. Pat. No. 5,182,035 and U.S. Pat. No. 5,510,045 and alkyl ether amine compounds as disclosed in U.S. Pat. No. 5,723,418 and U.S. Pat. No. 5,863,874, all of which are incorporated herein by reference in their entirety. Preferred fatty amine lubricant compositions contain an effective lubricating amount of one or more amine compounds including diamine acetates having the formula $[R^1NHR^2NH_3]^+(CH_3CO_2)^-$ or $[R^1NH_2R^2NH_3]^{2+}(CH_3CO_2)_2^-$ wherein $R^1$ is a $C_{10}$-$C_{18}$ aliphatic group or a partially unsaturated $C_{10}$-$C_{18}$ aliphatic group and $R^2$ is a $C_1$-$C_5$ alkylene group and fatty monoamine acetates having the formula $[R^1R^3R^4NH]^+(CH_3CO2)^-$ wherein $R^1$ is a $C_{10}$-$C_{18}$ aliphatic group or a partially unsaturated $C_{10}$-$C_{18}$ aliphatic group, and $R^3$ and $R^4$ are independently selected from H and $CH_3$. Particularly preferred fatty amine lubricant compositions contain one or more of oleyl propylene diamine diacetate, coco alkyl propylene diamine diacetate, and lauryl dimethyl amine acetate. Preferred fatty amine lubricant compositions may also include nonionic surfactants such as alcohol ethoxylates, chlorine, methyl, propyl or butyl end capped alcohol ethoxylates, ethoxylated alkyphenol compounds, and poly(ethylene oxide-propylene oxide) copolymers.

Preferred ethoxylate compound conveyor lubricants include compositions based on one or more of the group including alcohol ethoxylates, chlorine, methyl, propyl or butyl end capped alcohol ethoxylates, ethoxylated alkyphenol compounds, and poly(ethylene oxide-propylene oxide) copolymers as disclosed in U.S. Pat. No. 5,559,087 which is incorporated herein by reference in its entirety. Particularly preferred ethoxylate compound conveyor lubricants have a cloud point for the composition greater than about 100° F. Ethoxylate compounds with relatively lower cloud points may be advantageously used in combination with other ethoxylate compounds with higher cloud points, hydrotropes such as alkyl aryl sulfonate compounds, and other so called coupling agents.

Lubricant compositions which comprise a plurality of materials which improve the PET compatibility including hardness ions, stoichiometric amounts of acid, and wetting agents may exhibit a synergistic effect, that is, the overall reduction of the failure rate for PET bottles may be greater than the sum of the reduction of the failure rate for either a stoichiometric amount of acid, wetting agent, or hardness element acting alone.

The lubricant compositions can contain functional ingredients if desired. For example, the compositions can contain hydrophilic diluents, antimicrobial agents, stabilizing/coupling agents, detergents and dispersing agents, anti-wear agents, viscosity modifiers, corrosion inhibitors, film forming materials, antioxidants or antistatic agents. The amounts and types of such additional components will be apparent to those skilled in the art. As previously discussed, the present invention may in some embodiments substantially exclude sequestering agents or chelating agents.

Preferred lubricant compositions may be foaming, that is, they may have a foam profile value greater than about 1.1 when measured using a Foam Profile Test. A Foam Profile Test is disclosed in the aforementioned U.S. patent application Ser. No. 11/233,596 titled SILICONE LUBRICANT WITH GOOD WETTING ON PET SURFACES and in the present invention.

The lubricant compositions preferably create a coefficient of friction (COF) that is less than about 0.20, more preferably less than about 0.15, and most preferably less than about 0.12, when evaluated using the Short Track Conveyor Test described below.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant compositions of the present invention are especially designed for use with carbonated soft drink containers but can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRAPAK™ boxes), cans, bottles and the like. Although any desired portion of the container can be coated with the lubricant composition, the lubricant composition preferably is applied only to parts of the container that will come into contact with the conveyor or with other containers. For some such applications the lubricant composition preferably is applied to the conveyor rather than to the container.

The lubricant compositions of the present invention can be a liquid or semi-solid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition.

Methods of Application

Aqueous compositions used for rinsing bottles may be applied to bottles through standard shower heads or spray nozzles. Equipment useful for rinsing PET bottles includes Series 600 rinsers available from Uni-Pak, Longwood Fla. In the case that an aqueous composition is applied to bottles to raise the temperature of the contents, the aqueous composition is preferably recycled in a so called bottle warmer apparatus, for example bottle warmers available from Uni-Pak, Longwood Fla.

Lubricant compositions can be applied in a constant or intermittent fashion. Preferably, the lubricant composition is applied in an intermittent fashion in order to minimize the amount of applied lubricant composition. Preferred dry lubricant compositions may be applied for a period of time and then not applied for at least 15 minutes, at least 30 minutes, or at least 120 minutes or longer. The application period may be long enough to spread the composition over the conveyor belt (i.e. one revolution of the conveyor belt). During the application period, the actual application may be continuous, i.e. lubricant is applied to the entire conveyor, or intermittent, i.e. lubricant is applied in bands and the containers spread the lubricant around. The lubricant is preferably applied to the conveyor surface at a location that is not populated by packages or containers. For example, it is preferable to apply the lubricant upstream of the package or container flow or on the inverted conveyor surface moving underneath and upstream of the container or package. A particularly preferred method of application of lubricant compositions including lubricant compositions that are applied intermittently is by spraying through non-energized nozzles, as disclosed in the aforementioned U.S. patent application Ser. No. 11/351,863, which is incorporated herein by reference in its entirety.

In some embodiments, the ratio of application time to non-application time may be 1:1, 1:10, 1:30, 1:180, and 1:500 where the lubricant maintains a low coefficient of friction in between lubricant applications.

In some embodiments, a feedback loop may be used to determine when the coefficient of friction reaches an unacceptably high level. The feedback loop may trigger the lubricant composition to turn on for a period of time and then optionally turn the lubricant composition off when the coefficient of friction returns to an acceptable level.

The lubricant coating thickness preferably is maintained at least about 0.0001 mm, more preferably about 0.001 to about 2 mm, and most preferably about 0.005 to about 0.5 mm.

Application of the lubricant composition can be carried out using any suitable technique including spraying, wiping, brushing, drip coating, roll coating, and other methods for application of a thin film.

Improving the PET compatibility of aqueous compositions used during the filling and conveying of PET bottles can facilitate the activity of lightweighting PET bottles, and accordingly, in the presence of aqueous compositions comprising hardness ions, the weight of PET bottle used for a twenty ounce serving of a carbonated soft drink may be reduced from over 25 grams per bottle to less than 25 grams per bottle, less than 24 grams per bottle, and less than 23 grams per bottle. Improving the PET compatibility of aqueous compositions used during the filling and conveying of PET bottles can facilitate the use of polymers other than PET, and accordingly, in the presence of aqueous compositions comprising hardness ions, bottles used for carbonated soft drinks may contain greater than 10% by weight of a polymer other than PET Improving the PET compatibility of aqueous compositions used during the filling and conveying of PET bottles through the incorporation of hardness ions can reduce the risk of stress cracking in the case that PET bottles contain recycled polymer and may allow the PCR polymer content in beverage bottles to be increased to greater than 12%, greater than 15%, and greater than 20%. The presence of hardness ions in aqueous compositions that contact PET bottles during filling and conveying may improve PET compatibility and diminish the incidence of stress cracking in PET bottles which comprise a barrier layer.

Aqueous compositions of the present invention can if desired be evaluated using a Foam Profile Test, a Short Track Conveyor Test and a PET Stress Crack Test.

Foam Profile Test

According to this test, 200 mL of room temperature lubricant composition in a stoppered 500 mL glass graduated cylinder was inverted 10 times. Immediately after the tenth inversion, the total volume of liquid plus foam was recorded. The stoppered cylinder was allowed to remain stationary, and 60 seconds after the last inversion of the cylinder the total volume of liquid plus foam was recorded. The foam profile value is the ratio of the total volume of liquid plus foam at 60 seconds divided by the original volume.

Short Track Conveyor Test

A conveyor system employing a motor-driven 83 mm wide by 6.1 meter long REXNORD™ LF polyacetal thermoplastic conveyor belt was operated at a belt speed of 30.48 meters/minute. Four 20 ounce filled PET beverage bottles were lassoed and connected to a stationary strain gauge. The force exerted on the strain gauge during belt operation was recorded using a computer. A thin, even coat of the lubricant composition was applied to the surface of the belt using conventional lubricant spray nozzles which apply a total of 3.2 gallons of lubricant composition per hour. The belt was allowed to run for 25 to 90 minutes during which time a consistently low drag force was observed. The coefficient of friction (COF) was calculated by dividing the drag force (F)

by the weight of the four 20 ounce filled PET beverage bottles plus the lasso (W): COF=F/W.

Pet Stress Crack Test

Compatibility of aqueous compositions with PET beverage bottles was determined by charging bottles with carbonated water, contacting with the aqueous composition, storing at elevated temperatures and humidity for a period of 28 days, and counting the number of bottles that either burst or leaked through cracks in the base portion of the bottle. Standard twenty ounce "contour" bottles (available from Southeastern Container, Enka N.C.) were charged successively with 557 g of chilled water at 0 to 5° C., 10.6 g of sodium bicarbonate, and 17.1 mL (21.1 g) of 50 weight percent citric acid solution in water. Immediately after addition of the citric acid solution, the charged bottle was capped, rinsed with deionized water and stored at ambient conditions (20-25° C.) overnight. Twenty four bottles thus charged were swirled for approximately five seconds in test composition, whereupon they were wetted with test aqueous composition up to the seam which separates the base and sidewall portions of the bottle, then placed in a standard bus pan (part number 4034039, available from Sysco, Houston Tex.) lined with a polyethylene bag. Additional test aqueous composition was poured into the bus pan around the bottles so that the total amount of test aqueous composition in the pan (carried in on bottles and poured in separately) was equal to 132 g. The test aqueous compositions were not foamed for this test. For each composition tested, a total of four bus pans of 24 bottles were used. Immediately after placing bottles and test aqueous composition into bus pans, the bus pans were moved to an environmental chamber under conditions of 100° F. and 85% relative humidity. Bins were checked on a daily basis and the number of failed bottles (burst or leak of liquid through cracks in the bottle base) was recorded. At the end of 28 days, the amount of crazing on the base region of bottles that did not fail during humidity testing was evaluated. A visual crazing score was given to bottles where 0=no crazing is evident, the bottle base remains clear; and 10=pronounced crazing to the extent that the base has become opaque.

EXAMPLES

The invention can be better understood by reviewing the following examples. The examples are for illustration purposes only, and do not limit the scope of the invention.

Comparative Example A

Soft Alkaline Water

An aqueous composition consisting of a solution of deionized water containing 100 ppm alkalinity as $CaCO_3$ was prepared by dissolving 0.168 g of sodium bicarbonate in 1000 g of deionized water. By analysis, the soft alkaline water contained 99.7 ppm total alkalinity as $CaCO_3$, <0.5 ppm calcium, <0.5 ppm magnesium, and total hardness as $CaCO_3$ equal to <1.5 ppm. The ratio of hardness as $CaCO_3$ to alkalinity as $CaCO_3$ was <0.02 to 1. The alkaline water aqueous composition was tested for PET compatibility as described above. After 28 days of storage under conditions of 100° F. and 85% relative humidity, 14 of 96 bottles had failed (15%). The crazing score for the unfailed bottles in this test was 2.4.

Example 1

Soft Alkaline Water Plus Calcium Chloride

An aqueous composition which contained 220 ppm of calcium chloride plus 100 ppm alkalinity as $CaCO_3$ was prepared by diluting 5 g of a 4.4% solution of calcium chloride in water with a solution of 0.168 g of sodium bicarbonate in 995 g of deionized water. The resulting aqueous composition contained hardness ion equivalent to 198 ppm hardness as $CaCO_3$ and the ratio of hardness as $CaCO_3$ to alkalinity as $CaCO_3$ was 1.98 to 1. The calcium chloride containing alkaline aqueous composition was tested for PET compatibility as described above. After 28 days of storage under conditions of 100° F. and 85% relative humidity, 0 of 96 bottles had failed (0%). The crazing score for the unfailed bottles in this test was 2.1. What this example shows is that adding the salt of a hardness ion to alkaline water to give an aqueous composition with a ratio of hardness to alkalinity equal to 1.98 to 1 is capable to reduce the failure rate of bottles in the PET compatibility test.

Example 2

Hard Alkaline Warmer Water

An aqueous composition consisting of hard alkaline water from a bottle warmer used for warming PET bottles on a conveyor line using a silicone lubricant was tested for PET compatibility as described above. The hard alkaline water sample was titrated to pH 8.3 and pH 4.0 using 0.1 N HCl, whereupon it was found that the sample contained 86.6 ppm bicarbonate alkalinity as $CaCO_3$ and 0.2 ppm carbonate alkalinity as $CaCO_3$ for a total alkalinity equal to 86.8 ppm as $CaCO_3$. A metals analysis was conducted by inductively coupled plasma (ICP) spectroscopy which showed that the sample contained 32 ppm calcium, 8 ppm magnesium, and total hardness as $CaCO_3$ equal to 115 ppm. The ratio of hardness as $CaCO_3$ to alkalinity as $CaCO_3$ was 1.32 to 1. The hard alkaline warmer water was tested for PET compatibility as described above. After 28 days of storage under conditions of 100° F. and 85% relative humidity, 0 of 96 bottles had failed (0%). The crazing score for the unfailed bottles in this test was 1.5. What this example shows is that substituting untreated, hard alkaline water with a ratio of hardness to alkalinity equal to 1.32 to 1 for soft alkaline water is capable to reduce the failure rate of bottles in the PET compatibility test.

Example 3

Soft Alkaline Water Plus Silicone Lubricant with Magnesium Chloride

A lubricant concentrate composition was prepared by adding 1.50 g of a solution of 10% PLURONIC F108 poly(ethylene oxide-propylene oxide) block copolymer (available from BASF Corporation, Mount Olive, N.J.), 12.5 g 30% $MgCl_2$, 7.99 g KATHON CG-ICP (available from Rohm and Haas Company, Philadelphia, Pa.), and 2.53 g of Lambent E2140FG silicone emulsion to 75.5 g deionized water. An aqueous lubricant composition was prepared by diluting 2.5 g of the lubricant concentrate composition with 997.5 g of a solution of 168 ppm sodium bicarbonate in deionized water. The resulting lubricant composition contained 94 ppm magnesium chloride (equivalent to 98 ppm hardness as $CaCO_3$) and 168 ppm sodium bicarbonate (equivalent to 100 ppm alkalinity as $CaCO_3$). The ratio of hardness as $CaCO_3$ to alkalinity as $CaCO_3$ was 0.98 to 1. The foam profile value for the composition measured as described above was 1.0. The lubricant composition was tested for PET compatibility as described above whereupon after 28 days of storage under conditions of 100° F. and 85% relative humidity, 5 of 96 bottles had failed (5%). The crazing score for the unfailed bottles in this test was 3.0. What this example shows is that adding a lubricant concentrate composition comprising a hardness ion salt to alkaline water to give a lubricant composition with a ratio of hardness to alkalinity equal to 0.98 to 1 is capable to reduce the failure rate of bottles in the PET compatibility test.

Example 4

Soft Alkaline Water Plus Silicone Lubricant with Magnesium Chloride

A lubricant concentrate composition was prepared by adding 0.33 g glacial acetic acid, 1.25 g GENAMIN LA302-D (available from Clariant Corporation, Mount Holly, N.C.), 0.4 g of SURFONIC L24-7 surfactant (available from Huntsman Corporation, Houston Tex.), 15.9 g 30% $MgCl_2$, 1.25 g KATHON CG-ICP, and 1.25 g Lambent E2140FG silicone emulsion to 79.6 g deionized water. An aqueous lubricant composition was prepared by diluting 2.5 g of the lubricant concentrate composition with 997.5 g of a solution of 168 ppm sodium bicarbonate in deionized water. In a separate experiment, a mixture of 2500 ppm of lubricant concentrate in deionized water without added alkalinity was titrated with 0.1 N HCl and the total alkalinity calculated as described above was determined to be 12 ppm as $CaCO_3$. The resulting lubricant composition contained 119 ppm magnesium chloride (equivalent to 125 ppm hardness as $CaCO_3$), 112 ppm total alkalinity as $CaCO_3$, and 168 ppm $NaHCO_3$ (equivalent to 100 ppm alkalinity as $CaCO_3$). The ratio of hardness to total alkalinity was 1.12 to 1 and the ratio of hardness to alkalinity from the dilution water was 1.25 to 1. The foam profile value for the composition measured as described above was 1.0. The lubricant composition was tested for PET compatibility as described above whereupon after 28 days of storage under conditions of 100° F. and 85% relative humidity, 0 of 96 bottles had failed (0%). The crazing score for the unfailed bottles in this test was 3.8. What this example shows is that adding a lubricant concentrate composition comprising the salt of a hardness ion to alkaline water to give a lubricant composition with a ratio of hardness to alkalinity equal to 1.25 to 1 is capable to reduce the failure rate of bottles in the PET compatibility test. In a separate test, 20 g of the lubricant concentrate composition was diluted with 3 Kg of the hard alkaline municipal water of Example 7, and 7 Kg of deionized water. The coefficient of friction between four 20 ounce "Global Swirl" bottles and Delrin track was 0.13.

Example 5

Soft Alkaline Water Plus Zinc Chloride

An aqueous composition which contained 136 ppm of zinc chloride plus 100 ppm alkalinity as $CaCO_3$ was prepared by diluting 10 g of a 1.36% solution of zinc chloride in water with a solution of 0.168 g of sodium bicarbonate in 1000 g of deionized water. The resulting aqueous composition contained hardness ion equivalent to 100 ppm hardness as $CaCO_3$ and the ratio of hardness as $CaCO_3$ to alkalinity as $CaCO_3$ was 1.00 to 1. The zinc chloride containing alkaline aqueous composition was tested for PET compatibility as described above. After 28 days of storage under conditions of 100° F. and 85% relative humidity, 0 of 96 bottles had failed (0%). The crazing score for the unfailed bottles in this test was 1.3. What this example shows is that adding the salt of zinc ion, a hardness ion, to alkaline water to give a solution with a ratio of hardness to alkalinity equal to 1.00 to 1 is capable to reduce the failure rate of bottles in the PET compatibility test.

Example 6

Hard Alkaline Municipal Water

Municipal water from Eagan, Minn. was tested for PET compatibility as described above. The hard alkaline municipal water sample was titrated to pH 8.3 and pH 4.0 using 0.1 N HCl, whereupon it was found that the sample contained 258 ppm bicarbonate alkalinity as $CaCO_3$ and 3 ppm carbonate alkalinity as $CaCO_3$ for a total alkalinity equal to 261 ppm as $CaCO_3$. A metals analysis was conducted by inductively coupled plasma (ICP) spectroscopy which showed that the sample contained 64 ppm calcium, 22 ppm magnesium, and total hardness as $CaCO_3$ equal to 249 ppm. The ratio of hardness as $CaCO_3$ to alkalinity as $CaCO_3$ was 0.95 to 1. The hard alkaline municipal water was tested for PET compatibility as described above except that twenty ounce "Global Swirl" bottles were substituted for twenty ounce contour bottles. After 28 days of storage under conditions of 100° F. and 85% relative humidity, 1 of 96 bottles had failed (1%). The crazing score for the unfailed bottles in this test was 2.0. What this example shows is that substituting untreated, hard alkaline water with a ratio of hardness to alkalinity equal to 0.95 to 1 for soft alkaline water is capable to reduce the failure rate of bottles in the PET compatibility test.

Comparative Example B

Softened Alkaline Municipal Water

Municipal water from Eagan, Minn. was softened and then tested for PET compatibility as described above. By analysis, the softened Eagan municipal water contained 262 ppm total alkalinity as $CaCO_3$, <0.5 ppm calcium, <0.5 ppm magnesium, and the total hardness as $CaCO_3$ was less than 4 ppm. The ratio of hardness as $CaCO_3$ to alkalinity as $CaCO_3$ was less than 0.02 to 1. The softened municipal water was tested for PET compatibility as described above except that twenty ounce "Global Swirl" bottles were substituted for twenty ounce contour bottles. After 28 days of storage under conditions of 100° F. and 85% relative humidity, 15 of 96 bottles had failed (16%). The crazing score for the unfailed bottles in this test was 1.9. What this comparative example shows is that softening hard alkaline water causes an increase in the failure rate of bottles in the PET compatibility test.

Comparative Example C

Soft Alkaline Water Plus Silicone Lubricant

An aqueous lubricant composition was prepared which contained 125 ppm Lambent E2140FG silicone emulsion, 7.5 ppm PLURONIC F108 poly(ethylene oxide-propylene oxide) block copolymer, 5.0 ppm methyl paraben, and 168 ppm sodium bicarbonate (equivalent to 100 ppm alkalinity as $CaCO_3$). The ratio of hardness as $CaCO_3$ to alkalinity as $CaCO_3$ was <0.02 to 1. The lubricant composition was tested for PET compatibility as described above except that twenty ounce "Global Swirl" bottles were substituted for twenty ounce contour bottles. After 28 days of storage under conditions of 100° F. and 85% relative humidity, 9 of 48 bottles (19%) had failed.

Example 7

Soft Alkaline Water Plus Silicone Lubricant with Calcium Chloride

An aqueous lubricant composition was prepared which contained 125 ppm Lambent E2140FG silicone emulsion, 7.6 ppm PLURONIC F108 poly(ethylene oxide-propylene oxide) block copolymer, 5.0 ppm methyl paraben, 220 ppm $CaCl_2$ (equivalent to 198 ppm hardness as $CaCO_3$) and 168 ppm sodium bicarbonate (equivalent to 100 ppm alkalinity as $CaCO_3$). The ratio of hardness as $CaCO_3$ to alkalinity as $CaCO_3$ was 1.98 to 1. The foam profile value for the composition measured as described above was 1.0. The silicone lubricant composition was tested for PET compatibility as described above except that twenty ounce "Global Swirl" bottles were substituted for twenty ounce contour bottles. After 28 days of storage under conditions of 100° F. and 85% relative humidity, 0 of 96 bottles had failed (0%). The crazing score for the unfailed bottles in this test was 2.6. What this example shows is that adding the salt of a hardness ion to an alkaline silicone containing lubricant composition such that the ratio of hardness to alkalinity is equal to 1.98 to 1 is capable to reduce the failure rate of bottles in the PET compatibility test.

Example 8

Soft Alkaline Water Plus Silicone Lubricant with Magnesium Chloride

An aqueous lubricant composition was prepared which contained 125 ppm Lambent E2140FG silicone emulsion, 7.5 ppm PLURONIC F108 poly(ethylene oxide-propylene oxide) block copolymer, 5.0 ppm methyl paraben, 189 ppm $MgCl_2$ (equivalent to 198 ppm hardness as $CaCO_3$) and 168 ppm sodium bicarbonate (equivalent to 100 ppm alkalinity as $CaCO_3$). The ratio of hardness as $CaCO_3$ to alkalinity as $CaCO_3$ was 1.98 to 1. The lubricant composition was tested for PET compatibility as described above except that twenty ounce "Global Swirl" bottles were substituted for twenty ounce contour bottles whereupon after 28 days of storage under conditions of 100° F. and 85% relative humidity, 0 of 96 bottles had failed (0%). The crazing score for the unfailed bottles in this test was 4.0. What this example shows is that adding the salt of a hardness ion to an alkaline silicone containing lubricant composition such that the ratio of hardness to alkalinity is equal to 1.98 to 1 is capable to reduce the failure rate of bottles in the PET compatibility test.

Example 9

Silicone Lubricant Made with Hard Alkaline Municipal Water

An aqueous lubricant composition was prepared which contained 125 ppm Lambent E2140FG silicone emulsion, 7.5 ppm PLURONIC F108 poly(ethylene oxide-propylene oxide) block copolymer, and 5.0 ppm methyl paraben in municipal water from Eagan, Minn. By analysis, the Eagan municipal water contained 261 ppm total alkalinity as $CaCO_3$, 64 ppm calcium, 22 ppm magnesium, total hardness as $CaCO_3$ equal to 249 ppm, and a ratio of hardness as $CaCO_3$ to alkalinity as $CaCO_3$ equal to 0.95 to 1. The lubricant composition was tested for PET compatibility as described whereupon after 28 days of storage under conditions of 100° F. and 85% relative humidity, 0 of 96 bottles had failed (0%). The crazing score for the unfailed bottles in this test was 2.0. What this example shows is that a diluting a silicone lubricant with hard alkaline water is capable to reduce the failure rate of bottles in the PET compatibility test relative to diluting with soft alkaline water.

Comparative Example D

Soft Alkaline Water Plus Ethoxylate Compound Lubricant

An aqueous lubricant composition was prepared which contained 388 ppm PLURONIC F108 poly(ethylene oxide-propylene oxide) block copolymer, 98 ppm ANTAROX BL-240 surfactant (available from Rodia, Cranbury N.J.), 48 ppm $H_2O_2$, 98 ppm NEODOL 25-9 surfactant (product of Shell Oil Company, Houston, Tex.), and 168 ppm sodium bicarbonate (equivalent to 100 ppm alkalinity as $CaCO_3$). The ratio of hardness as $CaCO_3$ to alkalinity as $CaCO_3$ was <0.02 to 1. The ethoxylate compound lubricant composition was tested for PET compatibility as described above except that twenty ounce "Global Swirl" bottles were substituted for twenty ounce contour bottles, whereupon after 28 days of storage under conditions of 100° F. and 85% relative humidity, 14 of 96 bottles had failed (15%). The crazing score for the unfailed bottles in this test was 7.2.

Example 10

Soft Alkaline Water Plus Ethoxylate Compound Lubricant with Calcium Chloride

An aqueous lubricant composition was prepared which contained 388 ppm PLURONIC F108 poly(ethylene oxide-propylene oxide) block copolymer, 98 ppm ANTAROX BL-240 surfactant, 48 ppm $H_2O_2$, 98 ppm NEODOL 25-9 surfactant, 220 ppm $CaCl_2$ (equivalent to 198 ppm hardness as $CaCO_3$) and 168 ppm sodium bicarbonate (equivalent to 100 ppm alkalinity as $CaCO_3$). The ratio of hardness as $CaCO_3$ to alkalinity as $CaCO_3$ was 1.98 to 1. The foam profile value for the composition measured as described above was 1.6. The aqueous ethoxylate compound lubricant composition was tested for PET compatibility as described above except that twenty ounce "Global Swirl" bottles were substituted for twenty ounce contour bottles, whereupon after 28 days of storage under conditions of 100° F. and 85% relative humidity, 0 of 96 bottles had failed (0%). The crazing score for the unfailed bottles in this test was 7.4. What this example shows is that adding the salt of a hardness ion to an alkaline ethoxylate compound containing lubricant composition such that the ratio of hardness to alkalinity is equal to 1.98 to 1 is capable to reduce the failure rate of bottles in the PET compatibility test.

Comparative Example E

Soft Alkaline Water Plus Commercial Conveyor Lubricant

An aqueous lubricant composition was prepared by diluting 5.0 g of SMARTFOAM PLUS lubricant concentrate composition (available from Pure-Chem Products Inc., Stanton Calif.) with 995 g of a solution of 168 ppm sodium bicarbonate in deionized water. SMARTFOAM PLUS is described as containing a primary alcohol ethoxylate compound. The resulting lubricant composition contained 2500 ppm SMARTFOAM PLUS and 168 ppm sodium bicarbonate (equivalent to 100 ppm alkalinity as $CaCO_3$). The ratio of hardness as $CaCO_3$ to alkalinity as $CaCO_3$ was <0.02 to 1. The SMARTFOAM PLUS lubricant composition was tested for PET compatibility. After 28 days of storage under conditions of 100° F. and 85% relative humidity, 20 of 96 bottles had failed (21%). The crazing score for the unfailed bottles in this test was 7.9.

Example 11

Soft Alkaline Water Plus Commercial Conveyor Lubricant with Magnesium Chloride

A lubricant concentrate composition was prepared by adding 75 g of deionized water and 25 g of 30% magnesium chloride to 100 g SMARTFOAM PLUS. An aqueous lubricant composition was prepared by diluting 5.0 g of the lubricant concentrate composition with 995 g of a solution of 168 ppm sodium bicarbonate in deionized water. The resulting lubricant composition contained 2500 ppm SMARTFOAM PLUS, 188 ppm magnesium chloride (equivalent to 197 ppm hardness as $CaCO_3$), and 168 ppm sodium bicarbonate (equivalent to 100 ppm alkalinity as $CaCO_3$). The ratio of hardness as $CaCO_3$ to alkalinity as $CaCO_3$ was 1.98 to 1. The commercial conveyor lubricant plus magnesium chloride composition was tested for PET compatibility as described above. After 28 days of storage under conditions of 100° F. and 85% relative humidity, 0 of 96 bottles had failed (0%). The crazing score for the unfailed bottles in this test was 7.6. What this example shows is that adding the salt of a hardness ion to composition of a commercial conveyor lubricant in alkaline water such that the ratio of hardness to alkalinity is equal to 1.98 to 1 is capable to reduce the failure rate of bottles in the PET compatibility test.

Comparative Example F

Soft Alkaline Water Plus Amine Based Conveyor Lubricant

An lubricant concentrate composition was prepared by adding 9.0 g of SURFONIC TDA-9 surfactant (available from Huntsman Corporation, Houston Tex.) to a mixture of 1.3 g of calcium chloride dihydrate, 6.43 g glacial acetic acid, 7.5 g of DUOMEEN OL (available from Akzo Nobel Surface Chemistry LLC, Chicago, Ill.), 3.0 g of DUOMEEN CD (available from Akzo Nobel Surface Chemistry LLC, Chicago, Ill.), 4.5 g GENAMIN LA302D, and 1.83 g of 45% potassium hydroxide in 63.4 g of softened water. An aqueous lubricant composition was prepared by diluting 5.0 g of the lubricant concentrate solution with 995 g of a solution of 336 ppm sodium bicarbonate in deionized water. In a separate experiment, 5000 ppm of lubricant concentrate in deionized water without added alkalinity was titrated with 0.1 N HCl and the total alkalinity was calculated as described above to be 208 ppm as $CaCO_3$. The lubricant composition containing 5000 ppm of lubricant concentrate prepared with alkaline water contained 50 ppm calcium chloride (equivalent to 45 ppm hardness as $CaCO_3$), 408 ppm total alkalinity as $CaCO_3$, and 336 ppm sodium bicarbonate (equivalent to 200 ppm alkalinity as $CaCO_3$). The ratio of hardness as $CaCO_3$ to total alkalinity as $CaCO_3$ was 0.11 to 1, and the ratio of hardness as $CaCO_3$ to alkalinity as $CaCO_3$ from the dilution water was 0.23 to 1. The lubricant composition was tested for PET compatibility as described above except that twenty ounce "Global Swirl" bottles were substituted for twenty ounce contour bottles whereupon after 28 days of storage under conditions of 100° F. and 85% relative humidity, 14 of 96 bottles had failed (15%).

Example 12

Soft Alkaline Water Plus Amine Based Conveyor Lubricant with Calcium Chloride

A modified lubricant concentrate composition was prepared by adding 57.9 g of deionized water and 3.05 g of calcium chloride to 39.1 g of the lubricant concentrate of Comparative Example F. A lubricant composition was prepared by diluting 12.8 g of the modified lubricant concentrate composition with 987.2 g of a solution of 336 ppm sodium bicarbonate in deionized water. In a separate experiment, 5000 ppm of lubricant concentrate in deionized water without added alkalinity was titrated with 0.1 N HCl and the total alkalinity calculated as described above to be 208 ppm as $CaCO_3$. The resulting aqueous lubricant composition contained 5000 ppm of the lubricant concentrate of Comparative Example F, 440 ppm total calcium chloride (equivalent to 397 ppm hardness as $CaCO_3$), 408 ppm total alkalinity as $CaCO_3$, and 332 ppm sodium bicarbonate (equivalent to 200 ppm alkalinity as $CaCO_3$). The ratio of hardness as $CaCO_3$ to total alkalinity as $CaCO_3$ was 0.97 to 1, and the ratio of hardness as $CaCO_3$ to alkalinity from the dilution water as $CaCO_3$ was 1.98 to 1. The amine based lubricant composition was tested for PET compatibility as described above except that the length of the test was 31 days instead of 28, twenty ounce "Global Swirl" bottles were substituted for twenty ounce contour bottles, and on days 4 and 15-17 the relative humidity in the test dropped from 85% to between 10 and 20%, and on days 18 to 31, the relative humidity was 78%. During the PET compatibility test, 0 of 96 bottles had failed (0%). The crazing score for the unfailed bottles in this test was 7.7. What this example shows is that adding the salt of a hardness ion to a composition of an amine conveyor lubricant in alkaline water such that the ratio of hardness to alkalinity is equal to 1.98 to 1 is capable to reduce the failure rate of bottles in the PET compatibility test.

Comparative Example G

Soft Alkaline Water

A solution of deionized water containing 50 ppm alkalinity as $CaCO_3$ was prepared by dissolving 0.168 g of sodium bicarbonate in 2000 g of deionized water. The ratio of hardness as $CaCO_3$ to alkalinity as $CaCO_3$ was <0.02 to 1. The alkaline water solution was tested for PET compatibility as described above. After 28 days of storage under conditions of 100° F. and 85% relative humidity, 12 of 96 bottles had failed (12%). The crazing score for the unfailed bottles in this test was 1.7.

Example 13

Silicone Lubricant Made with Hard Alkaline Municipal Water

An aqueous lubricant composition was prepared which contained 125 ppm Lambent E2140FG silicone emulsion, 7.6 ppm PLURONIC F108 poly(ethylene oxide-propylene oxide) block copolymer, 5.0 ppm methyl paraben, and 19.2% untreated municipal water from Eagan, Minn. in deionized water. By formulation using analytical data for the Eagan municipal water, the composition contained 50 ppm total alkalinity as $CaCO_3$, 12 ppm calcium, 4 ppm magnesium, total hardness as $CaCO_3$ equal to 48 ppm, and a ratio of hardness as $CaCO_3$ to alkalinity as $CaCO_3$ equal to 0.95 to 1. The lubricant composition was tested for PET compatibility as described above whereupon after 28 days of storage under conditions of 100° F. and 85% relative humidity, 0 of 96 bottles had failed (0%). The crazing score for the unfailed bottles in this test was 2.1. What this example shows is that diluting a silicone lubricant with hard alkaline water is capable to reduce the failure rate of bottles in the PET compatibility test relative to soft alkaline water with the same level of alkalinity.

Comparative Examples H-M and Examples 14-31

Formulas for six comparative example formulations and eighteen inventive formulations are shown in Table 1. SURPASS 100, STER-BAC, LUBODRIVE FP and LUBRI-KLENZ S are available from Ecolab, St. Paul, Minn. SMARTFOAM PLUS is available from Pure-Chem Products Inc., Stanton Calif. DICOLUBE TPB is available from JohnsonDiversey, Sturtevant, Wis.

TABLE 1

| | Example H (Comp.) | Example I (Comp.) | Example J (Comp.) | Example K (Comp.) | Example L (Comp.) | Example M (Comp.) |
|---|---|---|---|---|---|---|
| SURPASS 100 | 200 ppm | | | | | |
| STER-BAC | | 200 ppm | | | | |
| LUBODRIVE FP | | | 2500 ppm | | | |
| SMARTFOAM Plus | | | | 2500 ppm | | |
| DICOLUBE TPB | | | | | 2500 ppm | |
| LUBRI-KLENZ S | | | | | | 5000 ppm |
| 30% solution of magnesium chloride | | | | | | |
| 30% solution of calcium chloride | | | | | | |
| Warmer water of Example 2, softened | remainder | remainder | remainder | remainder | remainder | remainder |
| Warmer water of Example 2, as received | | | | | | |
| Ratio of hardness to alkalinity | <0.02:1 | <0.02:1 | <0.02:1 | <0.02:1 | <0.02:1 | <0.02:1 |
| Ratio of hardness to alkalinity from dilution water. | <0.02:1 | <0.02:1 | <0.02:1 | <0.02:1 | <0.02:1 | <0.02:1 |

| | Example 14 | Example 15 | Example 16 | Example 17 | Example 18 | Example 19 |
|---|---|---|---|---|---|---|
| SURPASS 100 | 200 ppm | | | | | |
| STER-BAC | | 200 ppm | | | | |
| LUBODRIVE FP | | | 2500 ppm | | | |
| SMARTFOAM Plus | | | | 2500 ppm | | |
| DICOLUBE TPB | | | | | 2500 ppm | |
| LUBRI-KLENZ S | | | | | | 5000 ppm |
| 30% solution of magnesium chloride | | | | | | |
| 30% solution of calcium chloride | | | | | | |
| Warmer water of Example 2, softened | | | | | | |
| Warmer water of Example 2, as received | remainder | remainder | remainder | remainder | remainder | remainder |
| Ratio of hardness to alkalinity | 1.32 to 1 | 1.32 to 1 | 1.32 to 1 | 1.32 to 1 | 1.32 to 1 | 0.30 to 1 |
| Ratio of hardness to alkalinity from dilution water. | 1.32 to 1 | 1.32 to 1 | 1.32 to 1 | 1.32 to 1 | 1.32 to 1 | 1.32 to 1 |

| | Example 20 | Example 21 | Example 22 | Example 23 | Example 24 | Example 25 |
|---|---|---|---|---|---|---|
| SURPASS 100 | 200 ppm | | | | | |
| STER-BAC | | 200 ppm | | | | |
| LUBODRIVE FP | | | 2500 ppm | | | |
| SMARTFOAM Plus | | | | 2500 ppm | | |
| DICOLUBE TPB | | | | | 2500 ppm | |
| LUBRI-KLENZ S | | | | | | 5000 ppm |
| 30% solution of magnesium chloride | 550 ppm | 550 ppm | 550 ppm | 550 ppm | 550 ppm | 550 ppm |
| 30% solution of calcium chloride | | | | | | |
| Warmer water of Example 2, softened | remainder | remainder | remainder | remainder | remainder | remainder |
| Warmer water of Example 2, as received | | | | | | |
| Ratio of hardness to alkalinity | 1.99 to 1 | 1.99 to 1 | 1.99 to 1 | 1.99 to 1 | 1.99 to 1 | 0.46 to 1 |

TABLE 1-continued

| | | | | | | |
|---|---|---|---|---|---|---|
| Ratio of hardness to alkalinity from dilution water. | 1.99 to 1 | 1.99 to 1 | 1.99 to 1 | 1.99 to 1 | 1.99 to 1 | 1.99 to 1 |

| | Example 26 | Example 27 | Example 28 | Example 29 | Example 30 | Example 31 |
|---|---|---|---|---|---|---|
| SURPASS 100 | 200 ppm | | | | | |
| STER-BAC | | 200 ppm | | | | |
| LUBODRIVE FP | | | 2500 ppm | | | |
| SMARTFOAM Plus | | | | 2500 ppm | | |
| DICOLUBE TPB | | | | | 2500 ppm | |
| LUBRI-KLENZ S | | | | | | 5000 ppm |
| 30% solution of magnesium chloride | | | | | | |
| 30% solution of calcium chloride | 650 ppm | 650 ppm | 650 ppm | 650 ppm | 650 ppm | 650 ppm |
| Warmer water of Example 2, softened | remainder | remainder | remainder | remainder | remainder | remainder |
| Warmer water of Example 2, as received | | | | | | |
| Ratio of hardness to alkalinity | 2.02 to 1 | 2.02 to 1 | 2.02 to 1 | 2.02 to 1 | 2.02 to 1 | 0.45 to 1 |
| Ratio of hardness to alkalinity from dilution water. | 2.02 to 1 | 2.02 to 1 | 2.02 to 1 | 2.02 to 1 | 2.02 to 1 | 2.02 to 1 |

Various modifications and alterations of this invention will be apparent to those skilled in the art without departing from the scope and spirit of the invention, and are intended to be within the scope of the following claims.

What is claimed is:

1. A method for processing or transporting hydrolytically susceptible polymer bottles filled with carbonated beverages along a conveyor comprising:

contacting the bottles with an aqueous composition comprising greater than about 25 ppm alkalinity as $CaCO_3$ wherein the value of hardness as ppm $CaCO_3$ minus alkalinity as ppm $CaCO_3$ is greater than about 0 ppm, applying to either the conveyor or the bottle a lubricant composition wherein the lubricant composition has a foam profile of greater than about 1.1; and wherein the aqueous composition and the lubricant composition are different compositions.

2. The method according to claim 1, wherein the value of hardness as ppm $CaCO_3$ minus alkalinity as ppm $CaCO_3$ is greater than about 10 ppm.

3. The method according to claim 1, wherein the value of hardness as ppm $CaCO_3$ minus alkalinity as ppm $CaCO_3$ is greater than about 20 ppm.

4. The method according to claim 1, wherein the lubricant is applied intermittently.

5. The method according to claim 4, wherein the ratio of lubricant non-application time to lubricant application time is greater than about 10:1.

6. The method of claim 1, wherein the bottle comprises polymers derived from renewable sources.

7. The method of claim 6, wherein the bottle comprises polymers derived from agricultural sources.

8. The method of claim 1, wherein the aqueous composition raises the temperature of the bottle contents.

9. The method of claim 8, wherein the aqueous composition comprises a sanitizing agent.

10. The method of claim 9, wherein the sanitizing agent comprises a quaternary ammonium compound.

11. The method of claim 9, wherein the sanitizing agent comprises peracetic acid.

12. The method of claim 8, wherein the aqueous composition comprises municipal water that has not undergone further treatment to reduce hardness.

13. The method of claim 1, wherein the lubricant is applied without dilution.

14. The method of claim 1, wherein the aqueous composition comprises greater than about 50 ppm alkalinity as $CaCO_3$.

15. The method of claim 1, wherein the aqueous composition and the lubricant composition are applied sequentially.

16. The method of claim 15, wherein the aqueous composition is a bottle rinse.

* * * * *